US005794366A

United States Patent [19]

Chien

[11] Patent Number: 5,794,366

[45] **Date of Patent: *Aug. 18, 1998**

[54] MULTIPLE SEGMENT ELECTRO-LUMINESCENT LIGHTING ARRANGEMENT

[76] Inventor: Tseng-Lu Chien, 8F, No. 29, Alley 73, Lin-Shen Street, Shi-Chi Town, Taipei, Hseng, Taiwan

[ * ] Notice: The term of this patent shall not extend beyond the expiration date of Pat. No. 5,752,337.

[21] Appl. No.: 746,706

[22] Filed: Nov. 15, 1996

Related U.S. Application Data

[63] Continuation-in-part of Ser. No. 729,408, Oct. 11, 1996, which is a continuation of Ser. No. 305,294, Sep. 15, 1994, Pat. No. 5,572,817.

[51] Int. Cl.[6] ..... G09F 13/22

[52] U.S. Cl. ..... 40/540; 40/581; 40/580

[58] Field of Search ..... 40/544, 581, 580

[56] References Cited

U.S. PATENT DOCUMENTS

| | | | |
|---|---|---|---|
| 3,153,745 | 10/1964 | Gurian et al. . | |
| 3,284,941 | 11/1966 | Kaup . | |
| 3,780,430 | 12/1973 | Feeney | 29/626 |
| 4,587,753 | 5/1986 | Harper | 40/451 |
| 4,645,970 | 2/1987 | Murphy | 313/509 |
| 4,935,851 | 6/1990 | Wood | 362/103 |
| 4,949,228 | 8/1990 | Lin et al. | 362/72 |
| 5,067,063 | 11/1991 | Granneman et al. | 362/156 |
| 5,111,366 | 5/1992 | Rife et al. | 362/31 |
| 5,245,516 | 9/1993 | de Haas et al. | 362/108 |
| 5,317,488 | 5/1994 | Penrod | 362/84 |
| 5,327,587 | 7/1994 | Hurwitz | 2/422 |
| 5,426,792 | 6/1995 | Murasko | 2/422 |
| 5,434,013 | 7/1995 | Fernandez | 428/690 |
| 5,469,342 | 11/1995 | Chien | 362/84 |

*Primary Examiner*—Cassandra H. Davis
*Attorney, Agent, or Firm*—Bacon & Thomas

[57] ABSTRACT

A multiple segment electro-luminescent panel includes a backsheet on which are formed lower electrodes and connection lines for a plurality of discrete electro-luminescent light segments, the segments being made up of the lower electrodes, an optional dielectric layer, a phosphor material coated, painted, or printed onto the lower electrodes, and upper electrodes and connection lines formed on the phosphor material and lower connection lines. A first frontsheet layer is provided over the light segments and connection lines and bonded to the backsheet, and a second frontsheet layer including windows or cut-outs for viewing the light segments is provided over the first front sheet layer. The second frontsheet layer may be in the form of the outer layer of the upper portion of an athletic shoe, or can take numerous other forms depending on the application, with the second frontsheet being secured to the backsheet and first frontsheet layer by stitching or other bonding methods applied to the non-illuminated areas of the panel.

21 Claims, 7 Drawing Sheets

FIG. 1
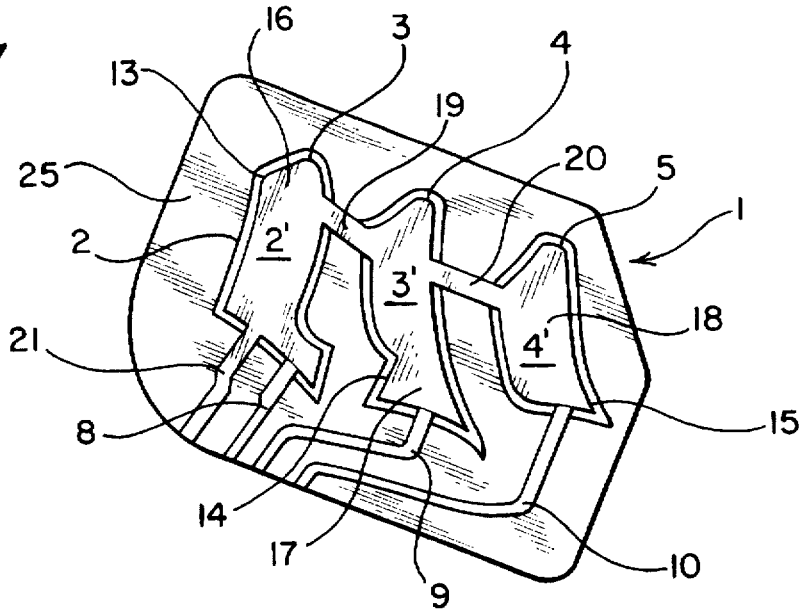
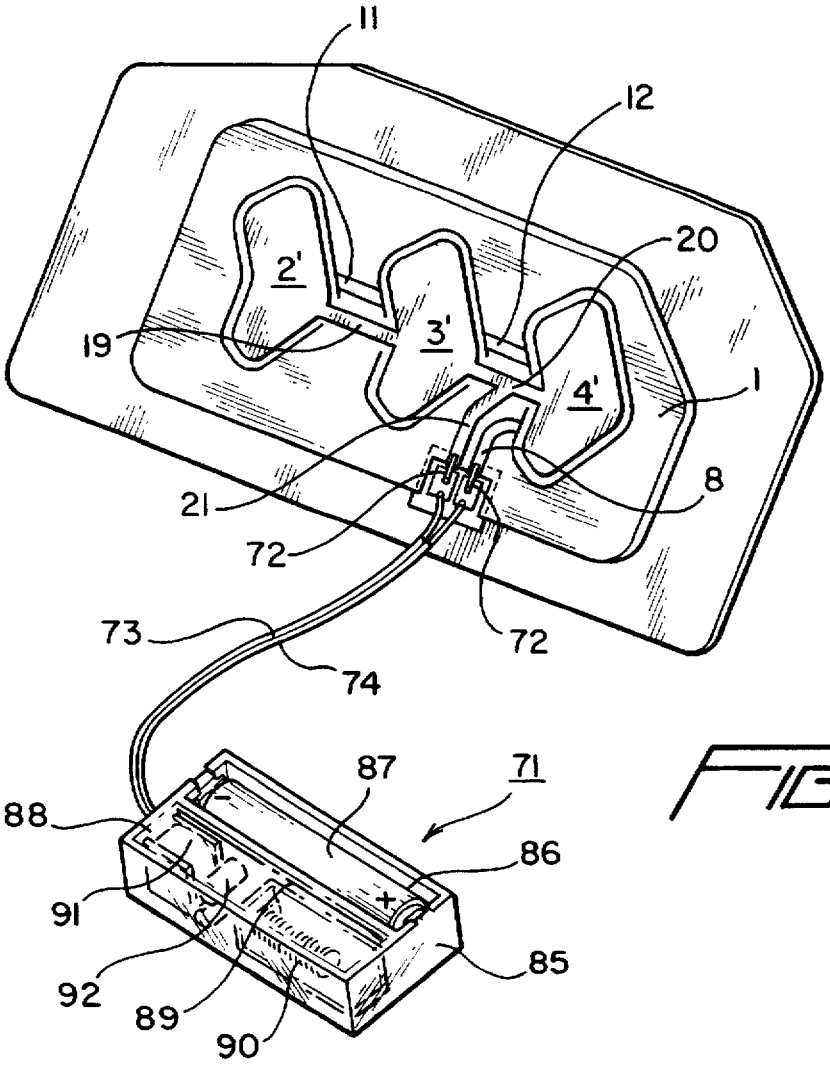
FIG. 8

MULTIPLE SEGMENT ELECTRO-LUMINESCENT LIGHTING ARRANGEMENT

This application is a Continuation-In-Part of U.S. patent application Ser. No. 08/729,408 filed Oct. 11, 1996, now pending, which is a Continuation of U.S. patent application Ser. No. 08/305,294, filed Sep. 15, 1994, now U.S. Pat. No. 5,572,817 issued on Nov. 12, 1996.

BACKGROUND OF THE INVENTION

1. Field of the Invention

This invention relates to an electro-luminescent lighting arrangement, and in particular to an electro-luminescent lighting arrangement made up of multiple discrete segments.

2. Discussion of Related Art

U.S. patent application Ser. No. 08/305,294, filed Sep. 15, 1994, now U.S. Pat. No. 5,572,817 issued on Nov. 12, 1996, and copending U.S. patent application Ser. Nos. 08/729,408, filed Oct. 11, 1996, which is a continuation of Ser. No. 08/305,294, and Ser. No. 08/734,872, filed Oct. 22, 1996, which is a divisional of U.S. patent application Ser. No. 08/305,294, disclose the concept of arranging a plurality of discrete electro-luminescent light segments situated on a pre-wired backsheet, and of including one or more frontsheets, with one of the frontsheets including windows or cut-outs through which the discrete electro-luminescent light segments are viewed.

The general concept of arranging discrete electro-luminescent light segments on a pre-wired backsheet and viewing the electro-luminescent light segments through windows or cut-outs in a frontsheet offers numerous advantages from the standpoints of cost, ease-of-production, attractiveness, and versatility, by reducing the amount of costly coatings and electro-luminescent materials required to obtain a desired lighting effect, by reducing the complexity of the process required to manufacture such a panel, and by increasing the flexibility of colorings, patterns, and special effects obtainable in the panel for an interesting and attractive appearance both in darkness and daylight for numerous different applications, while at the same time providing the convenience of a single panel rather than multiple panels.

Despite the numerous advantages of the multi-segment electro-luminescent panel described in U.S. Patent Application, however, the Inventor has made a number of improvements which further reduce costs, simplify manufacture, and improve the appearance and versatility of the basic multi-segment panel, including an improved wiring arrangement, improvements in manufacture of the light segments, and improvements in the frontsheet arrangement that enable the multi-segment panel to be more easily integrated into a wide variety of applications.

One of the improvements provided by the present invention involves manufacture of the individual segments by layering and/or coating techniques. While not limited to the techniques described therein, the Inventor's U.S. Pat. No. 5,469,342, issued on Nov. 21, 1995, describes an electro-luminescent strip formed by layering, the element constructed thereby taking the form of interconnected circles rather than discrete segments.

Also of particular interest is the Inventor's allowed U.S. patent application Ser. No. 08/409,925, filed Mar. 23, 1995, which is a continuation of U.S. patent application Ser. No. 08/226,330, filed Apr. 12, 1994, now abandoned, which discloses the basic principle of footwear having electro-luminescent panels on the upper portion of the shoe and a power supply in the bottom portion of the shoe. One of the embodiments of the present invention utilizes the principles described in this application by integrating a multi-segment electro-luminescent panel with the material of the shoe upper. It is anticipated that the multiple segment electro-luminescent panels will be adaptable for use in a variety of similar applications, including headwear, bags, flying objects, safety guides, signs, and numerous other applications described in various other pending and issued patent applications of the Inventor, as well as in other patents and publications, and such other contexts as will occur to those skilled in the art.

SUMMARY OF THE INVENTION

It is accordingly an objective of the invention to provide various improvements over the basic concept of a multi-segment electro-luminescent panel arrangement disclosed in parent U.S. patent application Ser. No. 08/305,294, and to expand the number of applications, including application to footwear of various types.

The improvements to which the present application are directed include, for example:

a. improved segment forming techniques, including formation of the discrete segments by painting, printing, or coating phosphor materials directly onto electrodes printed on the backsheet to not only reduce the amount of phosphor material required, saving cost and lowering power consumption, but to also decrease manufacturing costs and provide for greater design flexibility, including the formation of segments having different types of phosphor particles or particle mixtures to provide different illuminated and non-illuminated colors and designs, as well formation of elements having different shapes and sizes;

b. improved wiring techniques, including formation of the conductors by stamping or printing to further reduce manufacturing costs and increase design versatility, including the possibility of individually or commonly wiring the segments to form any desired combination of colors and special effects;

c. improved attachment arrangements made possible by the larger non-illuminated area, including the use of stitching, glue, solvents, hot-melt procedures, riveting, and ultra-sonic sealing, all of which present problems in conventional panels having a large illuminated area subject to damage by the above arrangements;

d. improved outer terminal location away from the illuminated area, overcoming a variety of production difficulties and limitations.

e. improved decorative appearance provided by the use of different colors of particles and different ink particles applied to the inner and outer layers to obtain different illuminated and non-illuminated patterns, and the possibility of adding thin filter sheets, overlays, or transparent ink to obtain further color changes or special effects unobtainable by simple arrangement of the phosphor particles;

f. reduced DC/AC inverter size as a result of the lower power consumption, permitting use in very limited spaces, including not only the shoe outsole, but also applications to pagers, mobile telephone units, watches, portable stereo or radio systems, heart monitors, and numerous other similar applications.

g. further improvements in flexibility provided by the large non-illuminated areas, which can be in the form of a simple conductive silver coating layer which can be bent over a larger angle than the phosphor coated areas, and which can be subjected to twisting, punching, cutting stitching, gluing, bonding, riveting, die cutting, and the like to facilitate installation of the panels in a particular application, and eliminate the need for special tooling to form gaps, grooves, or other special designs to locate the electro-luminescent panel in a specially designed space.

h. improved possibilities for providing special lighting effects through the use of individual wiring, permitting the segments to be independently controlled to exhibit a variety of special "motion" effects by causing the segments to be turned on and off according to predetermined patterns, including sequential and random patterns, chasing, and other effects, or to provide condition-sensitive switching of the elements, using relatively simple and compact control circuitry;

i. providing the increased number of colors and lighting effects without increasing the thickness of the resulting panels, allowing the panels to be used in a variety of different applications such as the upper portion of a shoe, for example in the shoe described in allowed U.S. patent application Ser. No. 08/409,165, by using the multi-layers of the shoe upper as the flexible frontsheet for the panel arrangement of this invention.

In accordance with the principles of a first preferred embodiment of the invention, for example, an improved phosphor arrangement for a multiple segment electro-luminescent panel in which the phosphor material is coated by any of a variety of coating, painting, or printing techniques directly onto electrodes printed or stamped onto the backsheet to form the discrete segments, leaving a relatively large non-illuminated area which not only reduces materials costs and power consumption, but also simplifies attachment of the panel to an object by enabling use of attachment techniques which would damage the phosphor material in the absence of the additional attachment space provided by the non-illuminated areas, such as stitching, glue, solvents, hot-melt procedures, riveting, and ultra-sonic sealing, and eliminates the need for separate wiring, alignment, and attachment of individual segments to the backsheet.

Furthermore, in the multiple segment electro-luminescent panel of the preferred embodiment of the invention, manufacturing costs are reduced and design flexibility increased by forming the terminals, connections, and/or electrodes for the multiple segments by stamping, printing, or layering of conductive materials directly onto the backsheet to form a first set of the conductive elements, and by subsequently stamping, printing, or layering of conductive materials onto discrete phosphor segments and/or an intermediate dielectric layer to form a second set of conductive elements, thereby decreasing assembly costs and enabling the discrete electro-luminescent segments to be wired in series or in parallel, or to be individually wired for independent control in order to obtain a variety of effects, including the special motion effects mentioned above.

In an especially advantageous adaptation of the panel of the preferred embodiment, the frontsheet which completes the embodiment is formed by the material of an upper portion of footwear, and in particular an athletic shoe in which the material of the upper portion is made up of a plurality of small pieces of material which together form the frontsheet, the frontsheet thus formed having cut-outs to permit viewing of the discrete illumination segment, with the power supply being located in a bottom portion or outsole of the shoe according to the principles described in U.S. patent application No. 08/409, 925. In another illustrated adaptation of the preferred panel, the frontsheet is formed by a sheet made of paper, PVC, leather, foil, or other materials having cut-outs of different shapes to form an illuminated greeting card similar to the one described in U.S. patent application Ser. No. 08/305,294.

It will of course be appreciated that the principles of the invention need not be limited to the footwear or greeting cards, but rather may be extended to numerous different applications ranging from apparel to safety equipment to consumer electronics and toys.

BRIEF DESCRIPTION OF THE DRAWINGS

FIG. 1 is a plan view of an electro-luminescent panel including three discrete phosphor segments and four outer terminals according to the principles of a first preferred embodiment of the invention.

FIG. 8 is a perspective view showing connection of the panel of FIG. 2A to a power supply.

DETAILED DESCRIPTION OF THE PREFERRED EMBODIMENTS

Figure 2A:
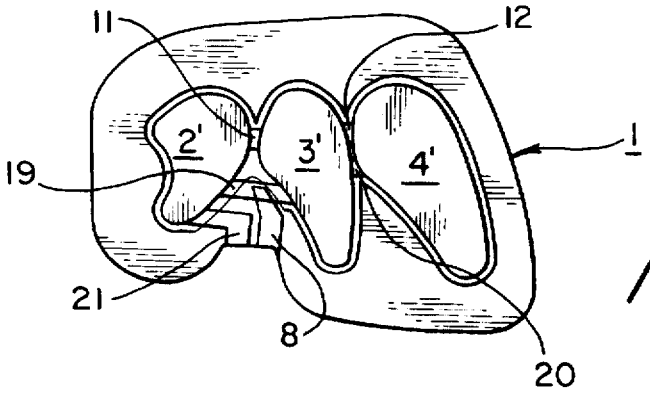
FIG. 2A is a plan view of an electro-luminescent panel including three discrete phosphor segments and two outer terminals according to a second preferred embodiment of the invention.
Figure 2B:
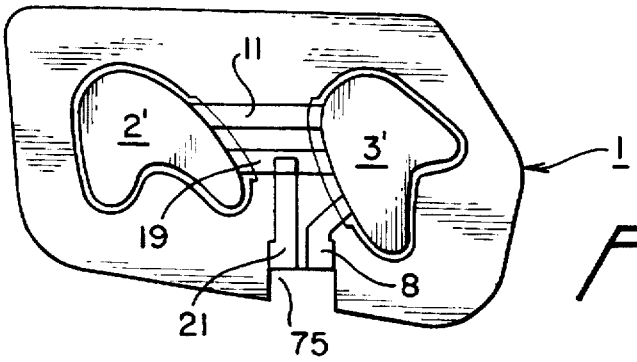
FIGS. 2B–2D are plan views of variations of the two terminal embodiment illustrated in FIG. 2A.
Figure 2D:
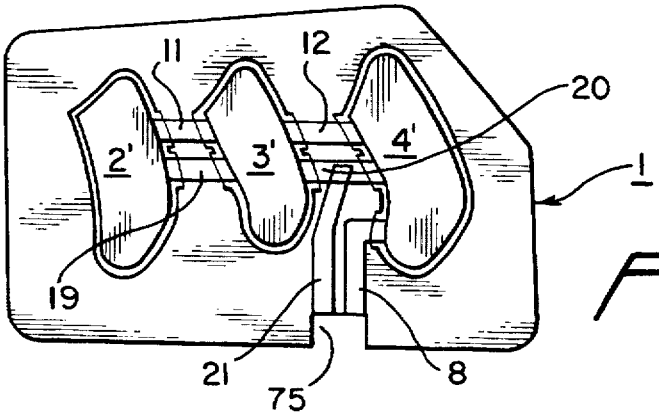
Figure 2C:
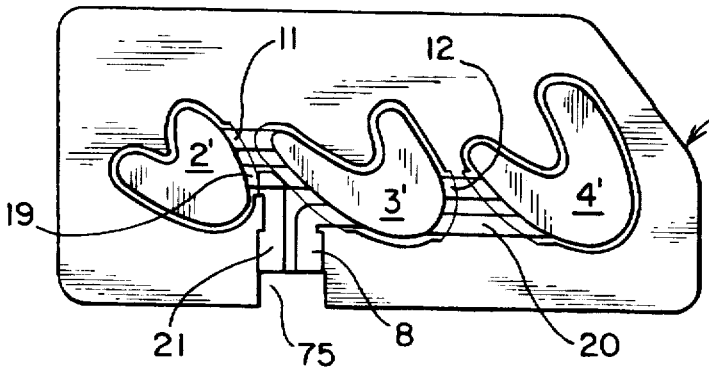

As illustrated in FIG. 1, a multiple segment electro-luminescent panel constructed according to the principles of a preferred embodiment of the invention includes a backsheet 1 on which three discrete electro-luminescent segments 2'–4' are formed. The number, size, shape, and orientation of the electro-luminescent segments is arbitrary, depending on the application, with three being illustrated for convenience, but the preferred designs include relatively large non-illuminated areas in addition to the electro-luminescent segments to facilitate processing and assembly. A suitable material for the backsheet is a clear plastic material such as PVC, although any flexible material can be used so long as it is able to undergo deposition, formation, or adhesion of conductive, the dielectric, and/or phosphor layers as described below.

The first layer deposited or formed on the backsheet include a lower conductive layer 2 arranged to form three discrete electrodes 3–5, three termination lines 8–10. Lower conductive layer 2 may be formed by any known circuit forming process, including printing, painting, silk-screening, soldering, plating, adhesion of foil, and so forth, and can be made of such materials as silver paste, copper foil or ribbons, conductive ink, and so forth. The electrodes of the lower layer are preferably formed of the same material and in the same manner as the connecting and termination lines, and have the same shape and cover a slightly larger area than the phosphor material to be deposited on top of the electrodes.

The next two layers formed on the backsheet and the lower conductive layer are a dielectric layer (not shown), which can be formed by any thin film forming method or by adhesion of a thin sheet of dielectric material, and a layer consisting of three discrete phosphor segments 13–15 formed over the electrodes by painting or deposition through a mask, printing, silkscreening, or other coating or deposition methods. If the three discrete phosphor segments are formed of the same material, the segments can be formed in a single step, but it is also possible to form the phosphor segments of different phosphor materials, or mixtures of the phosphor materials with different types of ink, to provide different colorings, both when illuminated and when non-illuminated, and to include both photo-luminescent and electro-luminescent particles, thus maximizing the design potential, with the shape of the phosphor segments being determined by the shape of the lower electrodes.

The next layer is an upper conductive layer made up of electrodes 16–18, connecting lines 19 and 20, and termination line 21, and which, like the lower conductive layer 2, can be formed by any known circuit forming process, including printing, painting, silk-screening, soldering, plating, adhesion of foil, and so forth, and can be made of such materials as silver paste, copper foil or ribbons, conductive ink, and so forth, except that the electrodes of the upper layer need to be made of a transparent material such as transparent conductive ink or plastic, or conductive glass, such as the conductive glass material described in the Inventor's U.S. Pat. No. 5,469,342. As illustrated in FIG. 1, the upper conductive layer is illustrated as being congruent to the lower layer, although This upper layer c an then be sealed within a completely or partially transparent protective first frontsheet layer made of a material similar to that of the backsheet to facilitate hand ling of the panel, non-illuminated areas 25 of either the backsheet or the first frontsheet layer can be left undecorated, printed, or otherwise decorated with messages, logos, and the like, prior attachment of a second frontsheet layer having cut-outs or windows as described below.

It will be appreciated that the upper and lower electrodes need to substantially sandwich the phosphor material in order to generate an alternating electric field across the phosphor material when current of appropriate frequency and voltage is applied to the electrodes, in order to cause the phosphor material to emit light having a frequency corresponding to a desired color through the transparent upper electrode.

Although control circuitry suitable for use with the panels of the preferred embodiments will be described in more detail below, it is noted that in the case of multiple color segments, which require application of different frequencies, special control circuitry is required, and that an especially advantageous circuit for providing the different frequencies is described in the Inventor's copending U.S. patent application Ser. No. 08/518,594. In addition, the inclusion of termination separate lines 8–10 for the three electro-luminescent segments of the embodiment illustrated in FIG. 1 offers improved possibilities for providing special lighting effects, permitting the segments to be independently controlled to exhibit a variety of special "motion" effects by causing the segments to be turned on and off according to predetermined patterns, including sequential and random patterns, chasing, and other effects, or to provide condition-sensitive switching of the elements, using relatively simple and compact control circuitry, on the other hand, where only simple lighting patterns are desired, two of the terminal lines can be eliminated, leaving only one lower termination line 8 and the upper termination line 21, as illustrated in FIGS. 2A–2D, with the respective electro-luminescent segments being connected by connecting lines 11, 12, 19, and 20. The construction of the various layers in these embodiments can be the same as described above for the four terminal embodiment of FIG. 1, and thus common reference numbering has been used, although the shapes and sizes of the respective electro-luminescent segments 2'–4' is different in each of FIGS. 2A–2D, illustrating just a few of the infinite numbers of different design possibilities achievable using the principles of the invention.

Because of the thinness of the layers formed by the above methods, the electro-luminescent segments will be relatively flexible, but the panel can be arranged depending on the application so that the maximum bending of the panel occurs in non-illuminated areas of the panel, and that the material or construction of the non-illuminated areas can be varied as necessary to facilitate bending, or to facilitate attachment of the panel to an object through the use of stitching, glue, solvents, hot-melt procedures, riveting, and ultra-sonic sealing, all of which present problems in conventional panels having a large illuminated area subject to damage by the above arrangements.

For example, the material of the connecting and termination lines formed in the non-illuminated areas can be a simple conductive silver coating layer which can be bent over a larger angle than the phosphor coated areas, and which can be subjected to twisting, punching, cutting stitching, gluing, bonding, riveting, die cutting, and the like to facilitate installation of the panels in a particular application, and also installation of terminals and external connections, to eliminate the need for special tooling to form gaps, grooves, or other special designs to locate the electro-luminescent panel in a specially designed space.

Figure 3:
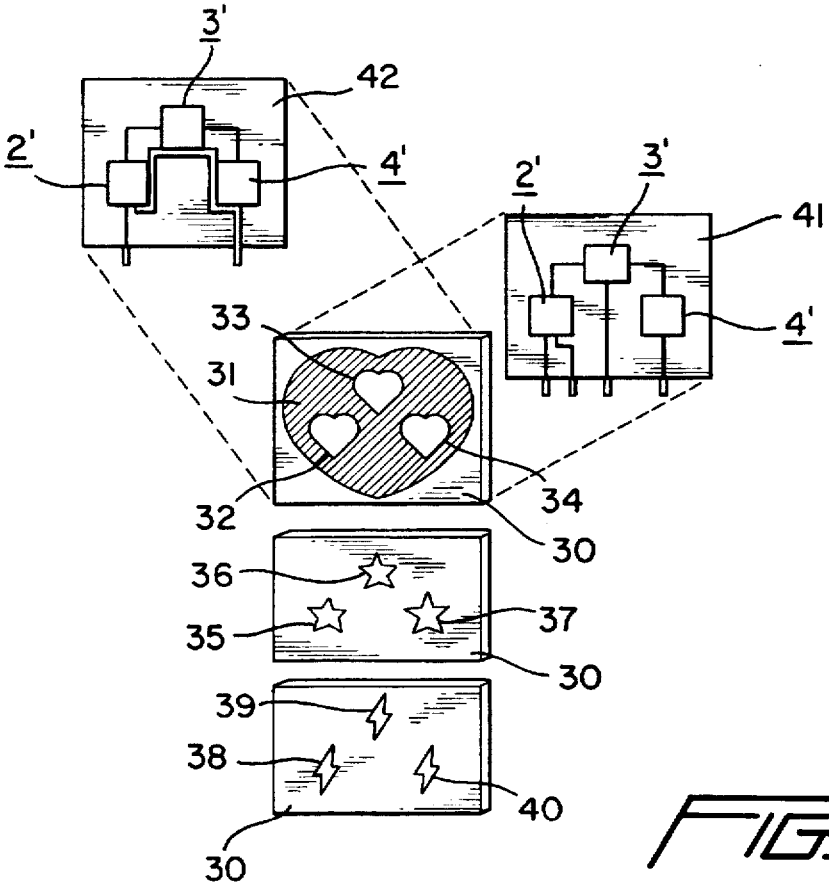
FIG. 3 is a schematic diagram showing application of the panels of the first two embodiments to a greeting card.

In the embodiment illustrated in FIG. 3, however, no special provision for bending need be made, since the embodiment is in the form of a greeting card, which is essentially planar. In this embodiment, the protective first frontsheet layer has affixed thereto a decorative frontsheet layer 30 made of an attractive material such as leather, foil, paper, or a high quality plastic such as PVE, through which is cut or stamped openings at locations corresponding to the locations 2'–4' of the light segments described above to permit light, upon illumination of the segments, to be visible from the front of the panel, and on which lettering or decorative patterns may be printed, painted, or silk-screened to form an arrangement which is attractive not only in the dark but also in daylight, which uses just enough of the electro-luminescent materials to obtain a desired effect, and which is simple to construct.

A particularly advantageous feature of this arrangement is that the same backsheet can be used with a variety of different frontsheets, thereby further saving production costs. In the example shown, the backsheet including individual electro-luminescent light segments 2'–4' is arranged to be used with at least different three different designs for frontsheet layer 30, including one having a large printed heart 31 and heart-shaped cutouts 32–34 corresponding to the locations of light segments 2'–4', a second design made up of three star-shaped cut-outs 35–37 also corresponding in location to the locations of light segments 2'–4', and finally a third more abstract design also involving cut-outs 38–40 located to allow light from the individual light segments to shine through the frontsheet. In addition, the arrangement illustrated in FIG. 3 can be used with either a two terminal panel arrangement 41 or a multiple terminal panel arrangement 42. Further details of this embodiment of the invention may be found in U.S. patent application Ser. No. 08/305,294.

Figure 4:
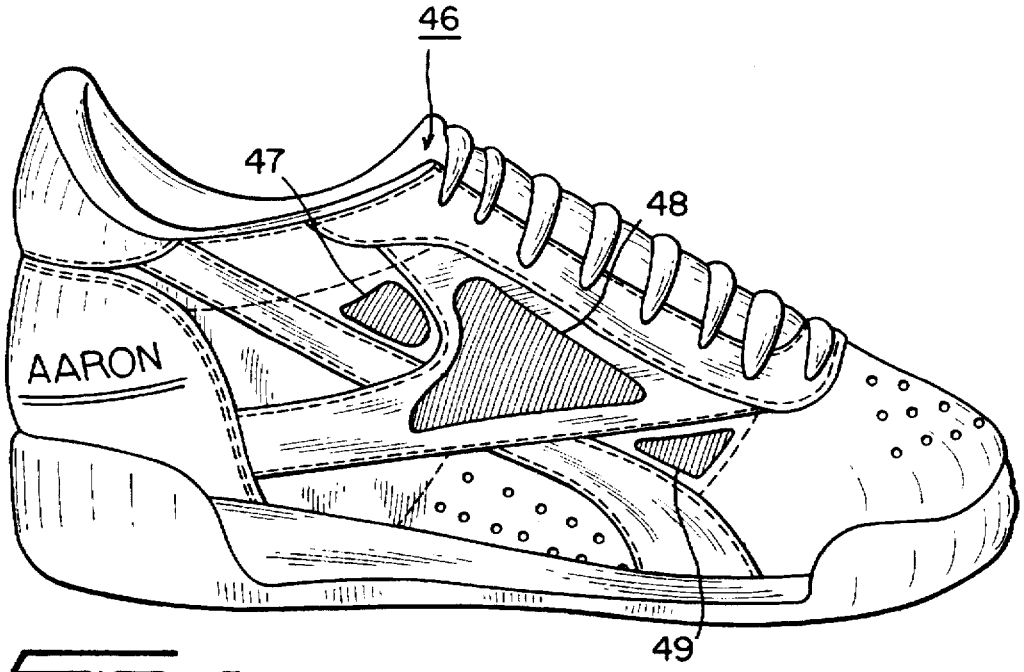
FIG. 4 is a perspective view showing application of the panels of the preferred embodiments to an athletic shoe.

In the embodiment illustrated in FIG. 4, on the other hand, the backsheet, conductive layers, phosphor layer, and first frontsheet layer are formed in the same manner as in described above, but the second frontsheet layer is in the form of a leather upper of a shoe 46. While there is nothing in U.S. patent application Ser. No. 08/305,294 that would limit application of the panel described therein to a greeting card, or to a second frontsheet with no purpose other than decoration, the true versatility of the invention is much more readily apparent from the footwear example, since the possibilities for application to other types of apparel and devices are greatly increased when one appreciates that the frontsheet layer having cut-outs 47–49 as described in U.S. patent application Ser. No. 08/305,294 in fact can be an integral part of a larger object, and have functions other than just the limited function of serving as a front sheet for the electro-luminescent panel.

Figure 6:
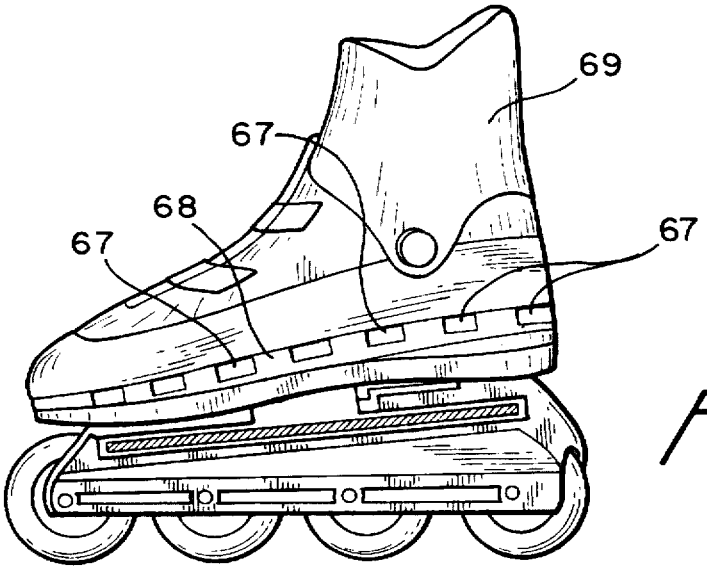
FIG. 6 is a perspective view showing a variation of the application illustrated in FIG. 5.
Figure 5:
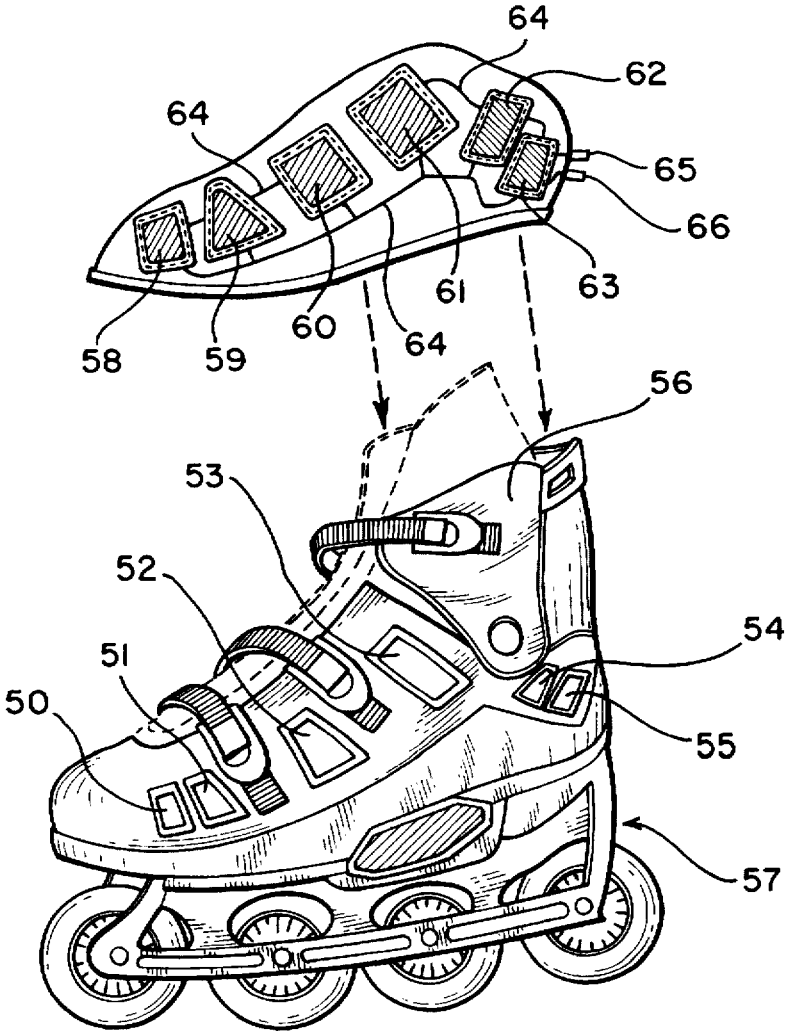
FIG. 5 is a perspective view showing application of the panels of the preferred embodiments to an in-line skate.
Figure 13A:
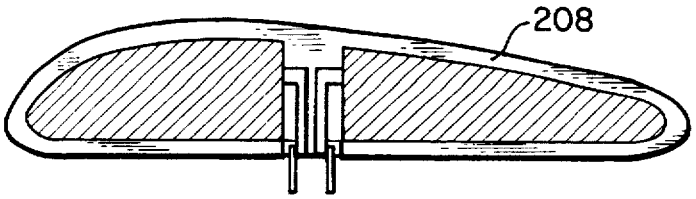
FIGS. 13A–13C show additional variations of the multiple segment panels of the preferred embodiments.
Figure 13B:
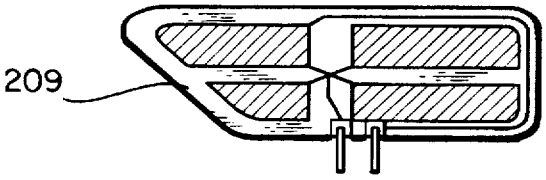
Figure 13C:
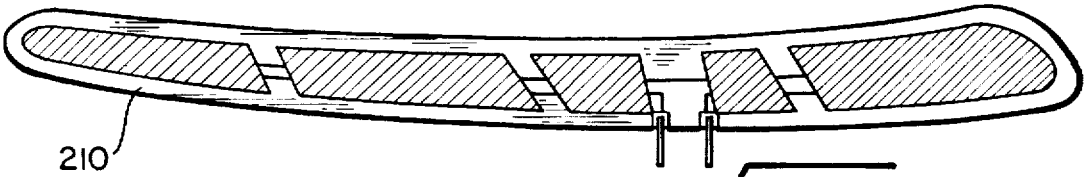

In the shoe shown in FIG. 5, the second frontsheet having cut-outs 50–55 is formed by the material of the upper portion 56 of a moving object such as an in-line skate boot 57 (with the power pack being situated in the bracket of the boot, as described in the Inventor's copending U.S. patent application Ser. No. 08/432,707), filed May 2, 1995, and the panel including segments 58-63 connected by lines 64 and including two terminals 65 and 66. Similarly, in the embodiment shown in FIG. 6, the second frontsheet having cut-outs 67 is formed in the outsole 68 of skate 69, which further illustrates the point that not only the segments, but the panel as a whole may have any desired shape, and also that the second frontsheet may be made of a rigid material. Examples of suitable panels 208–210 for the embodiments of FIGS. 5 and 6 are shown in FIGS. 13A–13C.

Figure 7:
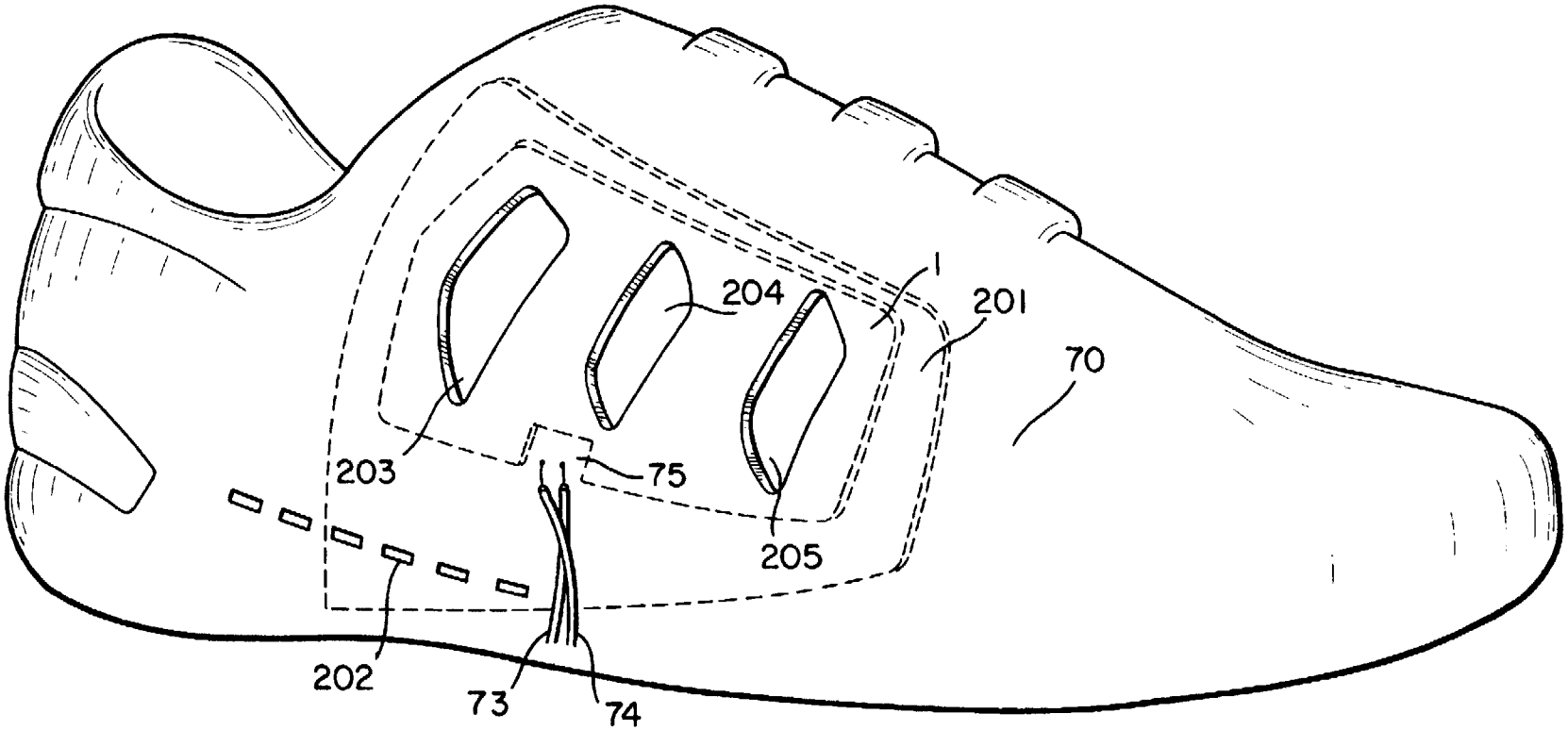
FIG. 7 is an schematic diagram illustrated construction details of the application illustrated in FIG. 4.

Returning to the athletic shoe embodiment of FIG. 4, the manner in which the panel is attached to the frontsheet being illustrated in FIG. 7, the backsheet 1 of the panel is first secured to an inner panel or material 201 of the shoe by any suitable attachment means separately applied to the non-illuminated portion of the panel, such as stitching, gluing, bonding, riveting, use of double-sided tape and the like, followed by attachment of the second frontsheet 70 having cut-outs 203–205 or, even more efficiently, the backsheet 1 is secured upon attachment of the second frontsheet to the inner panel or material of the shoe by whatever means, including stitching as indicated by dashed line 202, normally used to secure the inner and outer panels of the shoe together, thereby combining the step of attaching the second frontsheet with steps already used to assemble the shoe, resulting in significant savings in assembly costs. It will be appreciated that in the case of the illustrated athletic shoe, frontsheet 70 is actually made up of a plurality of small pieces of a material 70' such as canvas, rubber, or leather, which together make up the frontsheet, the frontsheet of the invention being of course not limited to a single piece of material.

Preferably, the panel is electrically connected to a power supply 71 (shown in FIG. 8) by means of suitable terminals 72 before attachment to the shoe, the power supply being of the type described in U.S. patent application Ser. No. 08/409,165, and located in the heel or outsole of the shoe. To facilitate attachment of the terminals 72 to the termination lines 8 and 21 and to connection wires 73 and 74, a notch 75 is conveniently provided at the edge of the backsheet and first frontsheet, with the terminals being crimped to the termination lines so as to extend into the notch 75. These terminals may either be connected directly to the power supply wires or, as illustrated in FIGS. 10 and 11, a circuit board 76 or folded over plastic sheet may advantageously be added to facilitate the termination by providing openings 78–81 connected by traces 82 and 83, with the terminals 72 being soldered into two of the openings 78 and 79 and the connection wires 73 and 74 being soldered into the remaining two openings 80 and 81.

Figure 9:
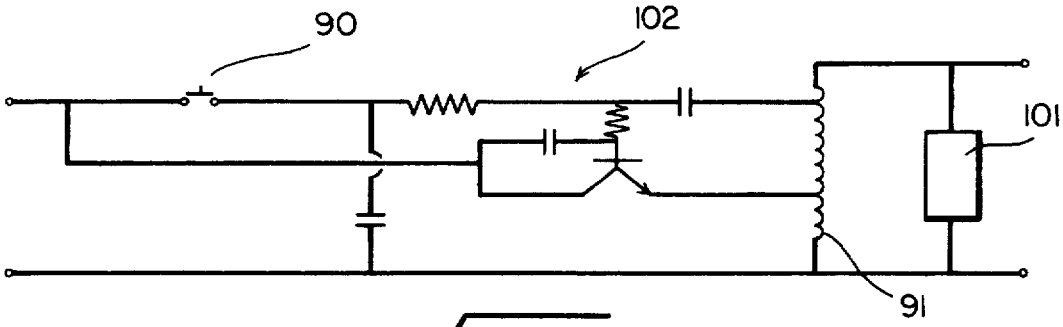
FIG. 9 is a functional block diagram of a circuit for use in the preferred embodiments.
Figure 10:
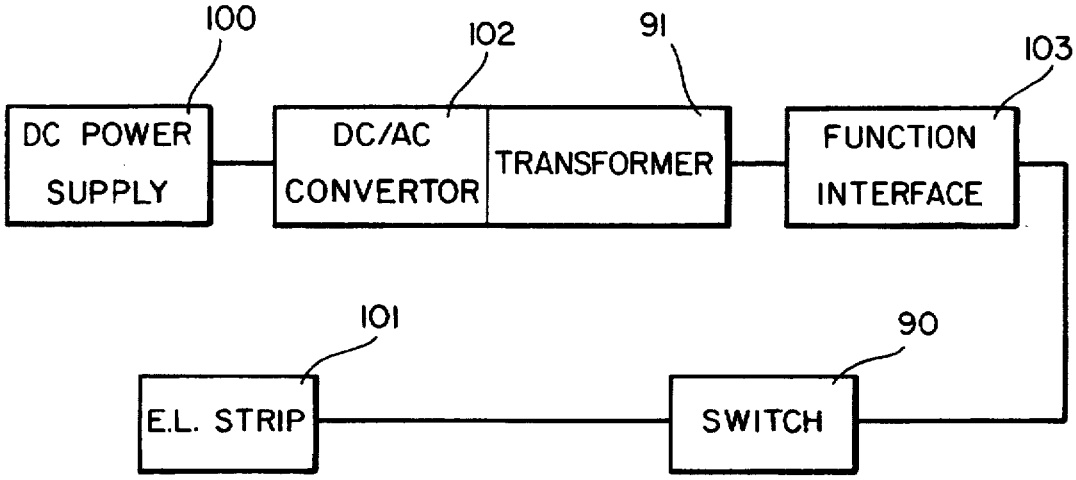
FIG. 10 is a schematic circuit diagram of the circuit of FIG. 9.
Figure 11:
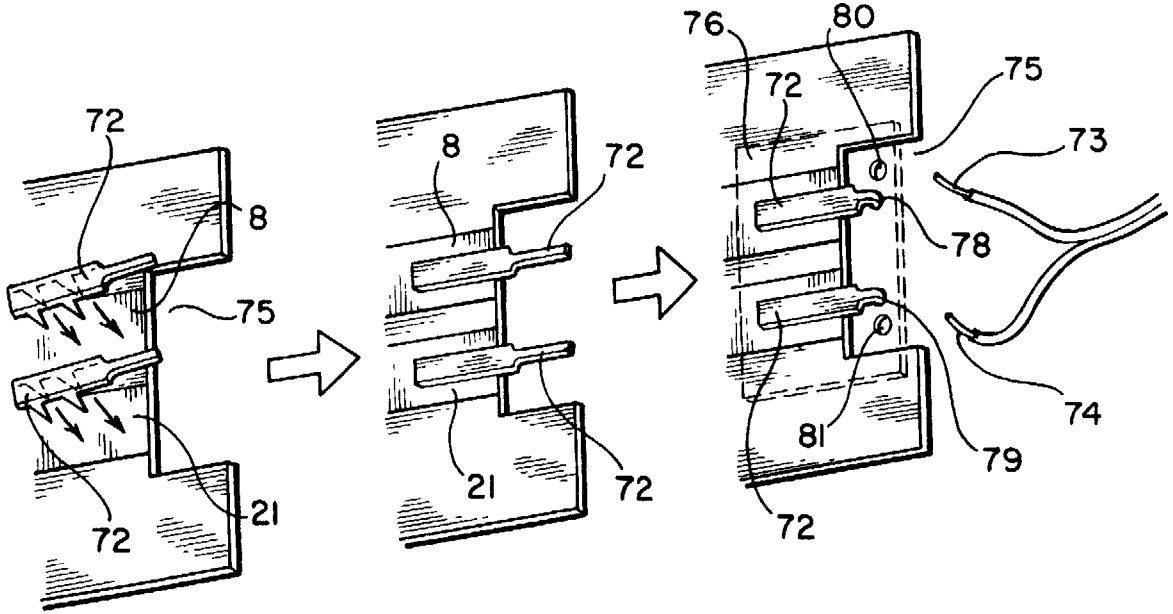
FIGS. 11 and 12 are a perspective views showing alternative connection arrangements for the multiple segment panels of the preferred embodiments.
Figure 12:
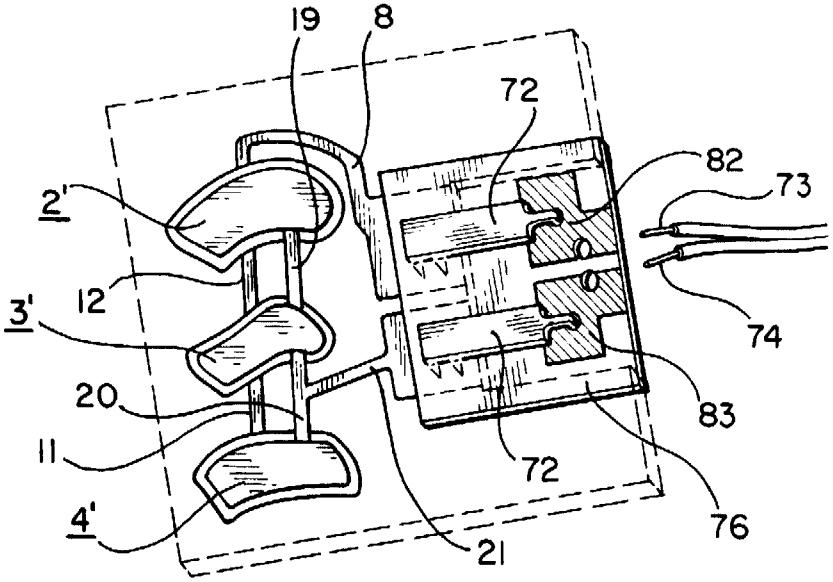

With reference to FIG. 8, the power supply to which wires 73 and 74 are connected includes a housing 85 including a battery compartment 86 containing a removable battery 87 and electrical terminals therefor (not shown) and a second compartment 88 containing a vertically positioned circuit board 89 on which are mounted a vibration switch 90, a transformer or inductor 91, and various additional electrical components 92 described more fully in connection with FIGS. 9 and 10.

As illustrated in FIGS. 9 and 10, the exemplary circuitry includes a DC power supply 100, which in addition to or instead of battery 87 may include a generator, solar cell, or other electrical power source, electrically connected to the electro-luminescent panel 101 via a circuit that includes a DC/AC inverter 102 electrically connected with transformer 91, transformer 91 being further electrically connected with a function interface 103 and, via parallel connected switch 90, to the lighting element panel 101. In operation, the direct current supplied by DC power source 100 is converted into an alternating current of a desired frequency by DC/AC inverter 102 and supplied to the transformer 91 for increasing the voltage of the alternating current, and then transmitted from the transformer 91 to the function interface 103. Function interface 103 can be arranged to provide a number of preset or switchable options for turning on the light segments of panel 101, e.g., steady or flashing, and in the case of panel having more than one terminal, can be arranged to vary the flashes to provide a number of different special effects, including random or sequential flashing, chasing, flashes of different durations, and so forth, utilizing either conventional analog circuitry or an integrated circuit controller as desired. It will be appreciated by those skilled in the art that various circuit elements other than the function interface may be modified or replaced for different applications, including the transformer, which could be replaced by an inductor and a switchable control element such as a transistor, for example as described in the Inventor's copending U.S. patent application Ser. No. 08/746,381, filed on Nov. 8, 1996.

Having thus described various preferred embodiments of the invention, those skilled in the art will appreciate that variations and modifications of the preferred embodiment may be made without departing from the scope of the invention. It is accordingly intended that the to invention not be limited by the above description or accompanying drawings, but that it be defined solely in accordance with the appended claims.

We claim:

1. A multiple segment electro-luminescent lighting arrangement, comprising:

a backsheet on which are formed a plurality of electro-luminescent light segments;

electrical circuit means on the backsheet for electrically connecting the light segments respectively to a power supply;

a phosphor material formed on a portion of the electrical circuit means constituting lower electrodes of the electro-luminescent light segments, a second portion of the electrical circuit means being formed on the phosphor material to constitute upper electrodes of the electro-luminescent light segments;

a first at least partially transparent frontsheet layer attached to the backsheet and covering said electro-luminescent light segments; and a second frontsheet layer secured to the backsheet and having openings for permitting passage of light from said electro-luminescent light segments therethrough.

2. A lighting arrangement as claimed in claim 1, wherein the phosphor material of each of said electro-luminescent light segments is the same.

3. A lighting arrangement as claimed in claim 1, wherein the phosphor material of different ones of said electro-luminescent light segments is different.

4. A lighting arrangement as claimed in claim 1, wherein the phosphor material includes phosphor particles with additional particles.

5. A lighting arrangement as claimed in claim 4, wherein said additional particles include ink particles.

6. A lighting arrangement as claimed in claim 1, wherein the phosphor material is a material applied by a process selected from the group consisting of painting through a mask, deposition through a mask, printing, and silkscreening.

7. A lighting arrangement as claimed in claim 1, wherein the electrical circuit means is made of a material selected from the group consisting of silver paste, copper foil, copper ribbons, and conductive ink.

8. A lighting arrangement as claimed in claim 1, wherein the electrical circuit means includes electrical circuit elements formed by a process selected from the group consisting of printing, painting, silk-screening, soldering, plating, and adhesion of conductive materials to the backsheet.

9. A lighting arrangement as claimed in claim 1, wherein the electrical circuit means includes separate termination lines to permit separate on/off control of different electro-luminescent segments.

10. A lighting arrangement as claimed in claim 1, wherein the electrical circuit means includes common termination lines for the electro-luminescent segments, said common termination lines being connected to two terminals situated at an edge of the backsheet away from the electro-luminescent segments.

11. A lighting arrangement as claimed in claim 10, wherein the two terminals are crimp terminals soldered to a circuit board positioned in a notch at the edge of the backsheet.

12. A lighting arrangement as claimed in claim 1, wherein the second frontsheet layer is made of a material selected from the group consisting of leather, plastic, PVC, EVA, wood, metal, rubber, paper, and cardboard.

13. A lighting arrangement as claimed in claim 1, wherein the second frontsheet layer is made up of a plurality of small pieces of material.

14. A lighting arrangement as claimed in claim 1, wherein the backsheet, the first at least partially transparent frontsheet layer, and the electro-luminescent segments are attached to the second frontsheet layer by attachment means selected from the group consisting of glue, double-sided tape, stitching, riveting, solvents, and hot stamping.

15. A lighting arrangement as claimed in claim 1, wherein the second frontsheet layer includes decorative designs selected from the group consisting of designs made by stencilling, masking, printing, painting, hot stamping, and application of decals.

16. A lighting arrangement as claimed in claim 1, wherein the second frontsheet layer is made a rigid material.

17. A lighting arrangement as claimed in claim 1, wherein the second frontsheet layer is a material of an upper surface of footwear.

18. A lighting arrangement as claimed in claim 17, wherein the footwear is a shoe having a power supply in a bottom portion of the shoe.

19. A lighting arrangement as claimed in claim 18, wherein the power supply and control circuitry for the lighting arrangement are situated in a housing positioned in the bottom portion of the shoe and connected to the electrical circuit means by wires.

20. A lighting arrangement as claimed in claim 1, wherein the second frontsheet is a material of surface of a moving object.

21. A lighting arrangement as claimed in claim 1, wherein the lighting arrangement forms a greeting card.

* * * * *